US012546518B2

(12) United States Patent
Feng et al.

(10) Patent No.: US 12,546,518 B2
(45) Date of Patent: Feb. 10, 2026

(54) GAS-LIQUID SEPARATOR AND AIR CONDITIONING DEVICE

(71) Applicant: ZHEJIANG DUNAN ARTIFICIAL ENVIRONMENT CO., LTD., Shaoxing (CN)

(72) Inventors: Zhongbo Feng, Shaoxing (CN); Feibing Wang, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 172 days.

(21) Appl. No.: 18/534,569

(22) Filed: Dec. 9, 2023

(65) Prior Publication Data

US 2024/0102707 A1 Mar. 28, 2024

Related U.S. Application Data

(63) Continuation of application No. PCT/CN2022/098116, filed on Jun. 10, 2022.

(30) Foreign Application Priority Data

Jun. 16, 2021 (CN) ..... 202110665946.X

(51) Int. Cl.
*F25B 43/00* (2006.01)

(52) U.S. Cl.
CPC ..... *F25B 43/006* (2013.01); *F25B 43/00* (2013.01); *F25B 43/003* (2013.01); *F25B 2400/23* (2013.01); *F25B 2500/18* (2013.01)

(58) Field of Classification Search
CPC ..... F25B 43/00; F25B 43/003; F25B 43/006
See application file for complete search history.

(56) References Cited

U.S. PATENT DOCUMENTS 2,953,906 A * 9/1960 Quick ..... F25B 47/022 62/81
4,199,960 A * 4/1980 Adams ..... F25B 43/006 96/147

(Continued)

FOREIGN PATENT DOCUMENTS

CN 101398240 A 4/2009
CN 104748460 A 7/2015

(Continued)

OTHER PUBLICATIONS

European search report of EP22824133.7.

(Continued)

*Primary Examiner* — Christopher R Zerphey

(57) ABSTRACT

A gas-liquid separator and an air conditioning device are provided. The gas-liquid separator includes a shell, a gaseous refrigerant outlet pipe, a filter member, and a fixed frame. The shell is provided with a liquid storage chamber. The gaseous refrigerant outlet pipe is at least partially disposed in the liquid storage chamber, and a portion of the gaseous refrigerant outlet pipe located in the liquid storage chamber is provided with a filter port. The filter member is fixedly connected to the filter port of the gaseous refrigerant outlet pipe to filter medium entering the gaseous refrigerant outlet pipe from the filter port. The fixed frame is fixedly connected to the shell and the filter member.

16 Claims, 5 Drawing Sheets

(56) References Cited

U.S. PATENT DOCUMENTS 5,076,071 A * 12/1991 Morse ..... F25B 43/006 96/195
5,233,842 A * 8/1993 Manning ..... F25B 43/006 62/472
5,507,159 A * 4/1996 Cooksey ..... F04B 39/0055 62/503
5,778,697 A * 7/1998 Wantuck ..... F25B 31/004 62/503
6,438,972 B1 * 8/2002 Pickett, Jr. ..... F25B 43/006 62/85
6,481,241 B1 * 11/2002 Fisk ..... F25B 43/003 62/503
6,568,204 B2 * 5/2003 Fisk ..... F25B 43/006 62/509
6,612,128 B2 * 9/2003 Dickson ..... F25B 43/006 62/509
6,689,198 B2 * 2/2004 Incorvia ..... B01D 53/0407 96/147
7,287,399 B2 * 10/2007 Obrist ..... F25B 43/006 62/503
8,099,976 B2 * 1/2012 Zhang ..... F25B 43/02 62/470
9,696,071 B2 * 7/2017 Pan ..... B01D 45/12
2009/0084130 A1 4/2009 Zhang et al.

FOREIGN PATENT DOCUMENTS

| | | | |
|---|---|---|---|
| CN | 104879971 | A | 9/2015 |
| CN | 206281261 | U | 6/2017 |
| CN | 211526778 | A | 9/2020 |
| CN | 213300535 | U | 5/2021 |
| CN | 215983373 | U | 3/2022 |
| JP | S56153775 | U | 11/1981 |
| JP | S56155278 | U | 11/1981 |
| JP | 2007232335 | A | 9/2007 |
| JP | 2017026192 | A | 2/2017 |

OTHER PUBLICATIONS

Notice of Reasons for Refusal of JP2023-566980.
International Search Report of PCT/CN2022/098116.
First notice of examination opinions of CN202110665946.X.

* cited by examiner

GAS-LIQUID SEPARATOR AND AIR CONDITIONING DEVICE

CROSS-REFERENCE TO RELATED APPLICATIONS

This application is a continuation of international patent application No. PCT/CN2022/098116, filed on Jun. 10, 2022, which itself claims priority to Chinese patent application No. 202110665946.X. filed on Jun. 16, 2021, titled "GAS-LIQUID SEPARATOR AND AIR CONDITIONING DEVICE". The content of the above applications is hereby incorporated by reference.

TECHNICAL FIELD

The present disclosure generally relates to the field of refrigeration, and in particular, to a gas-liquid separator and an air conditioning device.

BACKGROUND

A gas-liquid separator includes a shell, an air outlet pipe, and a fixed frame. The shell is provided with a liquid storage chamber, and the air outlet pipe is disposed in the liquid storage chamber and provided with a filtering member for filtering media entering the air outlet pipe by a filter port. Typically, the air outlet pipe is fixedly connected to the shell by the fixed frame, the air outlet pipe is in a shape of U, and a bottom end of the U-shaped air outlet pipe is clamped to the fixed frame. However, the shape of the air outlet pipe is irregular and a volume thereof is large, so it is difficult to connect the air outlet pipe to the fixed frame, which in turn makes it difficult to connect the air outlet pipe to the shell.

SUMMARY

According to various embodiments of the present disclosure, a gas-liquid separator and an air conditioning device are provided.

The present disclosure provides a gas-liquid separator, including a shell, a gaseous refrigerant outlet pipe, a filter member, and a fixed frame. The shell is provided with a liquid storage chamber. The gaseous refrigerant outlet pipe is at least partially disposed in the liquid storage chamber, and a portion of the gaseous refrigerant outlet pipe located in the liquid storage chamber is provided with a filter port. The filter member is fixedly connected to the filter port of the gaseous refrigerant outlet pipe to filter medium entering the gaseous refrigerant outlet pipe from the filter port. The fixed frame is fixedly connected to the shell and the filter member.

In an embodiment of the present disclosure, the filter member includes a screen, a connector, and a main seat body connecting to the screen and the connector, and the connector extends into the filter port and is fixedly connected to the gaseous refrigerant outlet pipe.

In an embodiment of the present disclosure, the fixed frame is provided with a clamp hole, and the fixed frame is sheathed on an outside of the connector by the clamp hole.

In an embodiment of the present disclosure, a portion of the fixed frame provided with the clamp hole abuts between the gaseous refrigerant outlet pipe and the main seat body.

In an embodiment of the present disclosure, an end of the fixed frame is connected to an inner wall of the shell by welding, and the other end of the fixed frame is provided with the clamp hole.

In an embodiment of the present disclosure, the fixed frame comprises a first connecting plate and a second connecting plate connected in a shape of L, an end of the first connecting plate away from the second connecting plate is connected to the shell, and an end of the second connecting plate away from the first connecting plate is connected to the filter member.

In an embodiment of the present disclosure, both ends of the fixed frame are connected to an inner wall of the shell by welding, and the clamp hole is located at a center of the fixed frame.

In an embodiment of the present disclosure, both ends of the fixed frame are bent at 90° to form a flap structure, and the fixed frame is welded to the shell by the flap structure.

In an embodiment of the present disclosure, an inner diameter of the clamp hole is denoted as d, a width of the fixed frame is denoted as h, and the inner diameter d of the clamp hole and the width h of the fixed frame satisfy the following relational formula: $0.3h \leq d \leq 0.7h$.

In an embodiment of the present disclosure, the main seat body is in a shape of a conical pipe, and an outer diameter of the main seat body gradually increases from an end of the main seat body proximal to the connector to the other end of the main seat body away from the connector; the screen is in a shape of a cylinder, and the screen is disposed on the end of the main seat body away from the connector.

The present disclosure further provides an air conditioning device, including the gas-liquid separator of any one of the above embodiments.

Details of one or more embodiments of the present disclosure are set forth in the following accompanying drawings and description. Other features, objects, and advantages of the present disclosure will become apparent from the specification, the accompanying drawings, and the claims.

BRIEF DESCRIPTION OF THE DRAWINGS

Reference may be made to one or more of the accompanying drawings for a purpose of better describing and illustrating the embodiments and/or examples of those applications disclosed herein. Additional details or examples used to describe the accompanying drawings should not be considered a limitation on the scope of any of the disclosed applications, the embodiments and/or examples presently described, and the best mode of these applications as presently understood.

Figure 1:
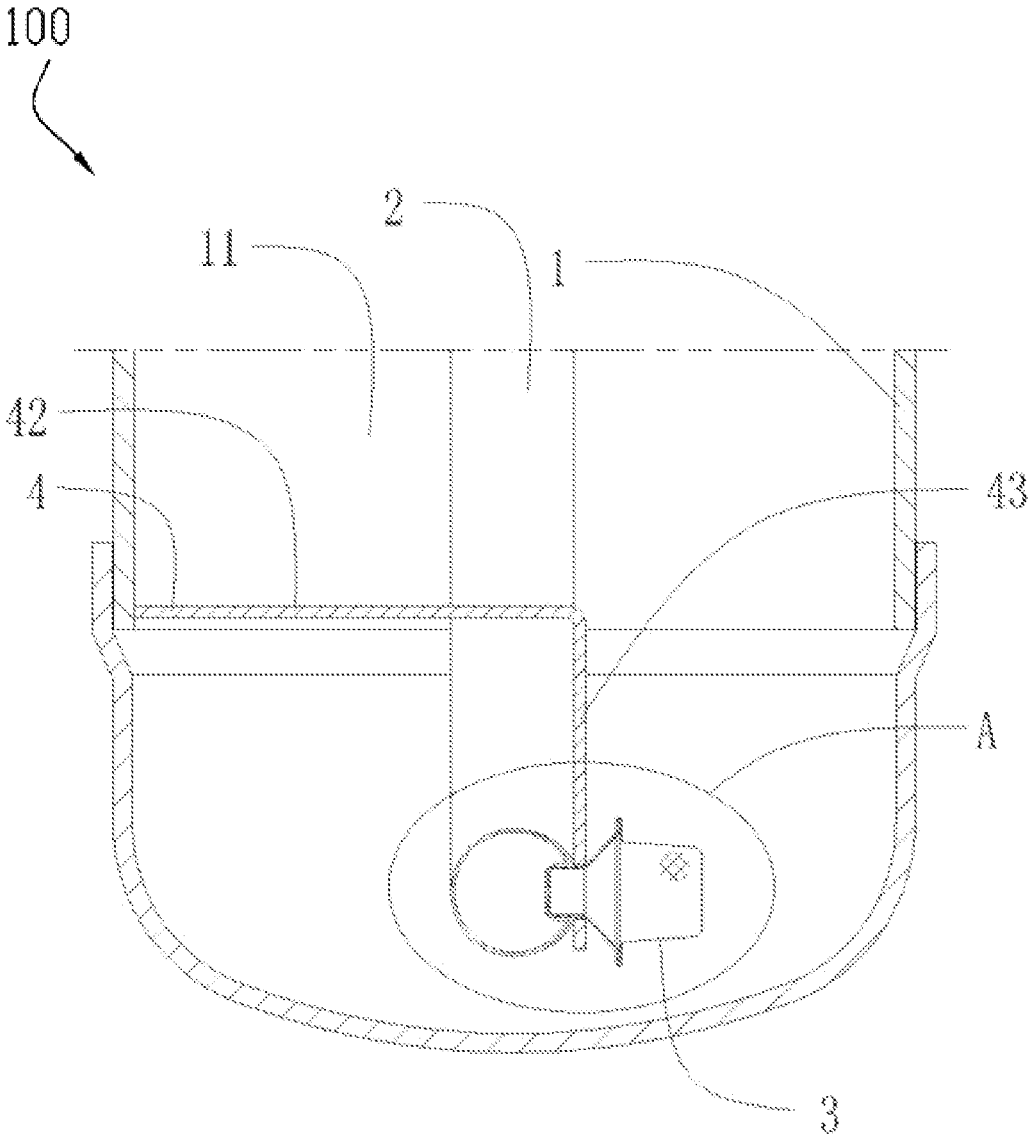
FIG. 1 is a sectional diagram of a gas-liquid separator according to one or more embodiments.

In the figures, 100 represents a gas-liquid separator, 1 represents a shell, 11 represents a liquid storage chamber, 2 represents a gaseous refrigerant outlet pipe, 21 represents a filter port, 3 represents a filter member, 31 represents a main seat body, 32 represents a screen, 33 represents a connector, 4 represents a fixed frame, 41 represents a clamp hole, 42 represents a first connecting plate, 43 represents a second connecting plate, 44 represents a flap structure, 200 represents an air conditioning device.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without making creative labor are the scope of the present disclosure.

It should be noted that when an assembly is considered to be "disposed on" another assembly, it can be directly disposed to another assembly, or there can be a centered assembly. When an assembly is considered to be "set on" another assembly, it can be directly set on another assembly, or there can be a centered assembly at the same time. When an assembly is considered to be "fixed to" another assembly, it can be directly fixed to another assembly, or there can be a centered assembly at the same time.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "and/or" as used herein includes any and all combinations of one or more of the associated listed items.

Referring to FIG. 1, FIG. 2, FIG. 5, and FIG. 6, the present disclosure provides a gas-liquid separator 100, including a shell 1, a flow inlet pipe (not shown), a gaseous refrigerant outlet pipe 2, a filter member 3, and a fixed frame 4. The shell 1 is provided with a liquid storage chamber 11. The gaseous refrigerant outlet pipe 2 is at least partially disposed in the liquid storage chamber 11, and a portion of the gaseous refrigerant outlet pipe 2 located in the liquid storage chamber 11 is provided with a filter port 21. The filter member 3 is fixedly connected to the filter port 21 of the gaseous refrigerant outlet pipe 2 to filter medium entering the gaseous refrigerant outlet pipe 2 from the filter port 21.

Typically, refrigerant with two phases of gas and liquid may enter the liquid storage chamber 11 from the flow inlet pipe, and the refrigerant may be mixed with some lubricating oil for a compressor. After the refrigerant enters the liquid storage chamber 11, gaseous refrigerant may rise and enter the gaseous refrigerant outlet pipe 2, and liquid refrigerant mixed with the lubricating oil may directly sink into a bottom of the liquid storage chamber 11. A density of the liquid refrigerant and a density of the lubricating oil are different, and the liquid refrigerant and the lubricating oil are not miscible. Therefore, at the bottom of the liquid storage chamber 11, the liquid refrigerant and the lubricating oil would be stratified under an action of gravity, and the lubricating oil would float above the liquid refrigerant. After that, the lubricating oil may enter the outlet pipe 2 by the filter member 3 and return to the compressor together with the gaseous refrigerant. The liquid refrigerant remaining at the bottom of the liquid storage chamber 11 may also rise in the liquid storage chamber 11 and enter the gaseous refrigerant outlet pipe 2 after gasification, and finally return to the compressor.

In the present embodiment, referring to FIG. 1, FIG. 2, FIG. 5, and FIG. 6, since the gaseous refrigerant outlet pipe 2 is fixedly connected to the filter member 3, the fixed frame 4 is fixedly connected to the shell 1 and the filter member 3, thereby realizing a fixed connection between the gaseous refrigerant outlet pipe 2 and the shell 1. Compared with the gaseous refrigerant outlet pipe 2, the fixed frame 4 is easier to be fixedly connected to the filter member 3, and the fixed frame 4 and the filter member 3 have low connection difficulty. Therefore, in the present disclosure, the fixed frame 4 is fixedly connected to the filter member 3, greatly reducing connection difficulty between the gaseous refrigerant outlet pipe 2 and the shell 1.

It should be noted that fixed connection may include welding and clamping. In other words, the filter member 3 may be clamped at the filter port 21 of the gaseous refrigerant outlet pipe 2, or be connected to the filter port 21 of the gaseous refrigerant outlet pipe 2 by welding. Similarly, the fixed frame 4 may be connected to the shell 1 by welding, or be clamped to the shell. The fixed frame 4 may be connected to the filter member 3 by welding, or be clamped to the filter member 3. Not limited to the above, the fixed connection may also include screw connection, rivet connection and other connection manners.

Figure 2:
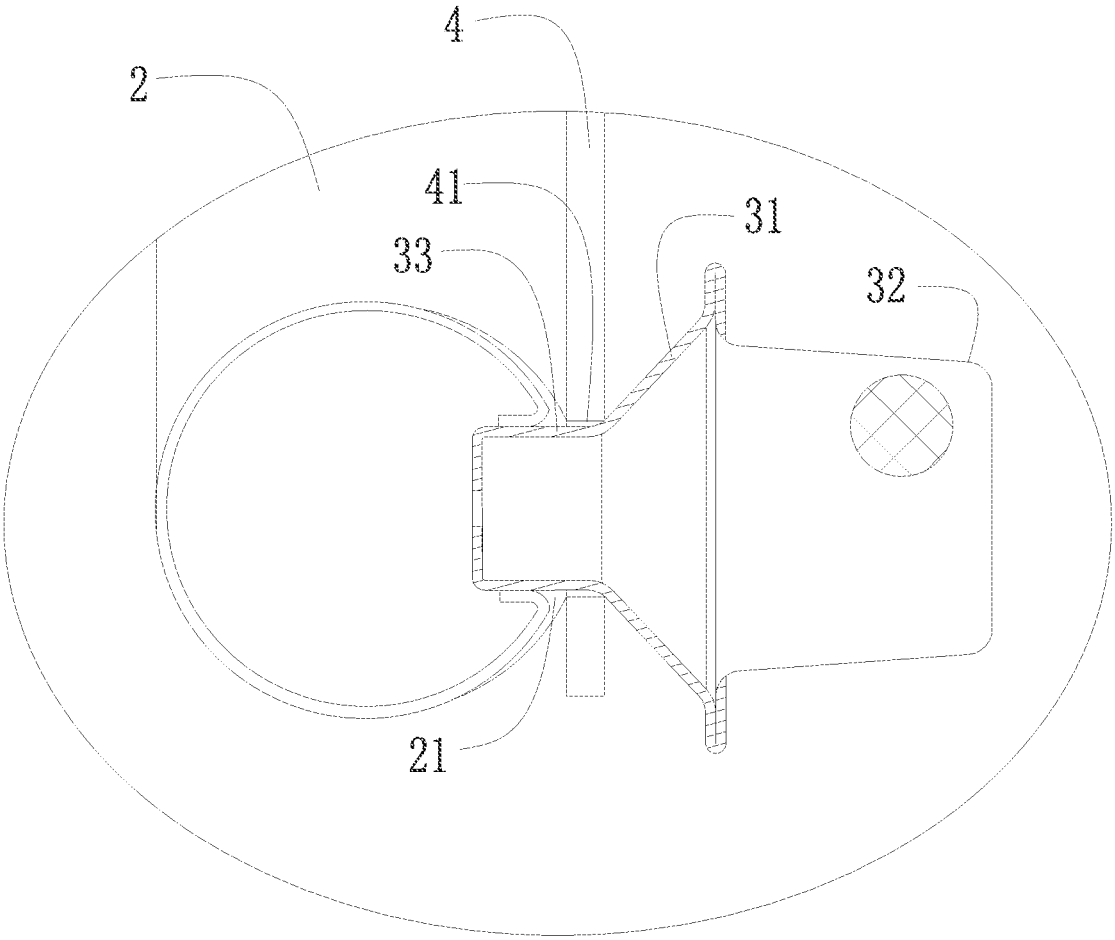
FIG. 2 is an enlarged diagram of A as shown in FIG. 1.
Figure 3:
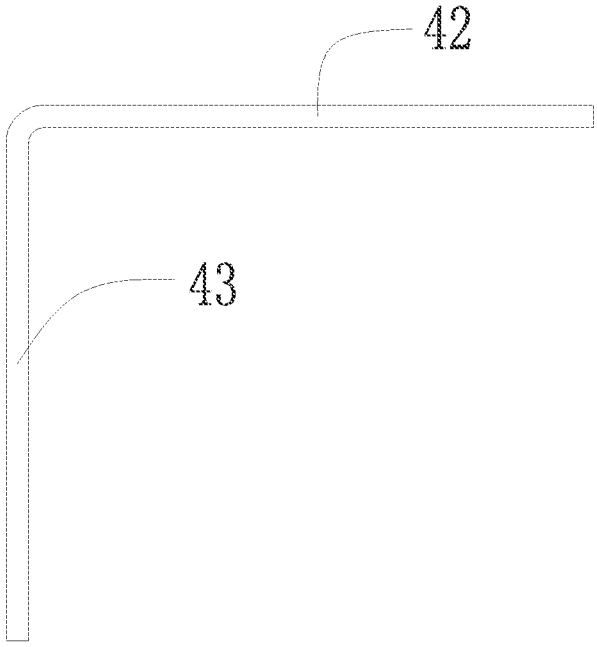
FIG. 3 is a first schematic diagram of a fixed frame according to one or more embodiments.
Figure 4:
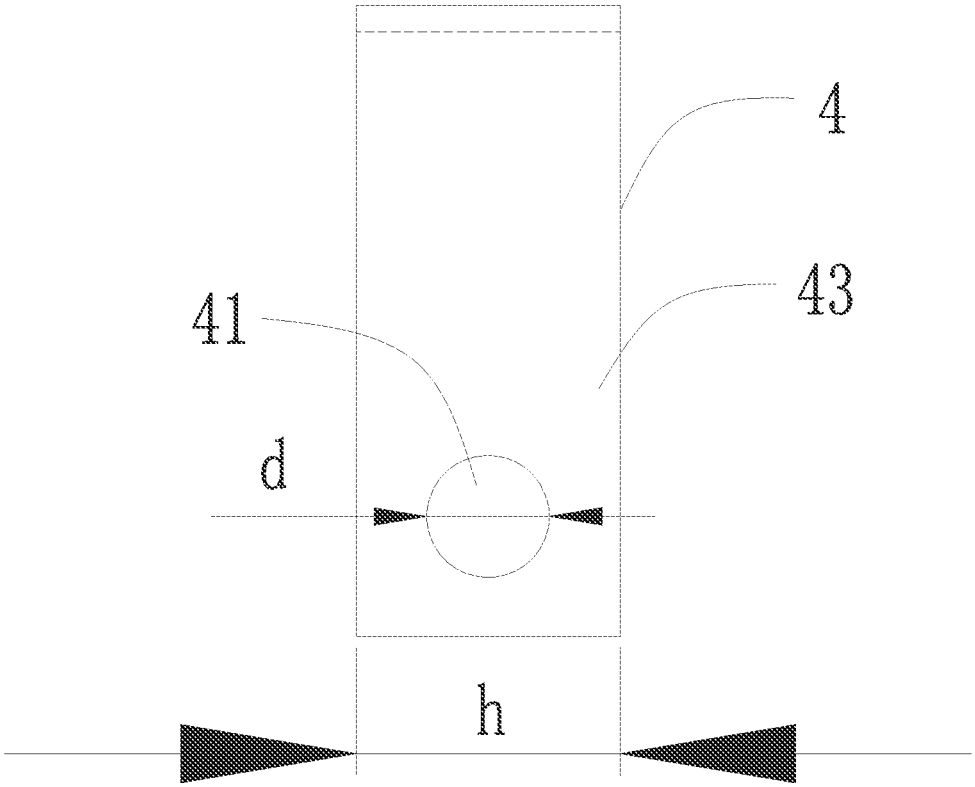
FIG. 4 is a second schematic diagram of a fixed frame according to one or more embodiments.

Furthermore, referring to FIG. 2, the filter member 3 may include a screen 32, a connector 33, and a main seat body 31 connecting to the screen 32 and the connector 33, and the connector 33 may extend into the filter port 21 and be fixedly connected to the gaseous refrigerant outlet pipe 2. The filter member 3 may extend into the filter port 21 by the connector 33 and be fixedly connected to the gaseous refrigerant outlet pipe 2, thereby increasing connection strength between the filter member 3 and the gaseous refrigerant outlet pipe 2. Specifically, the main seat body 31 may be in a shape of a conical pipe, and an outer diameter of the main seat body 31 may gradually increase from an end of the main seat body 31 proximal to the connector 33 to the other end of the main seat body 31 away from the connector 33. The screen 32 may be in a shape of a cylinder, and the screen 32 may be disposed on the end of the main seat body 31 away from the connector 33. In this way, it facilitates increasing filter area of the screen 32 and effectively improving oil return efficiency of the gas-liquid separator 100.

In an embodiment, referring to FIG. 1 to FIG. 7, the fixed frame 4 may be provided with a clamp hole 41, and the fixed frame 4 may be sheathed on an outside of the connector 33 by the clamp hole 41. In this way, the fixed frame 4 and filter member 3 may be more firmly assembled. Specifically, the fixed frame 4 may be first sheathed on the outside of the connector 33 by the clamp hole 41, and then the connector 33 may be inserted into the filter port 21 and be fixedly connected to the gaseous refrigerant outlet pipe 2. Furthermore, the outside of the connector 33 may be connected at the clamp hole 41 of the fixed frame 4 by welding, further improving connection firmness between the fixed frame 4 and the filter member 3.

Furthermore, referring to FIG. 2, a portion of the fixed frame 4 provided with the clamp hole 41 may abut between the gaseous refrigerant outlet pipe 2 and the main seat body 31. In this way, an end of the fixed frame 4 connected to the filter member 3 may be not easy to loosen, thereby effectively improving structural strength of the gas-liquid separator 100.

In an embodiment, referring to FIG. 1 to FIG. 4, an end of the fixed frame 4 may be connected to an inner wall of the shell 1 by welding, and the other end of the fixed frame 4 may be provided with the clamp hole 41. In other words, the end of the fixed frame 4 may be connected to the shell 1, and the other end of the fixed frame 4 may be connected to the filter member 3. In this way, the fixed frame may have a simpler structure, which facilitates processing and manufacturing of the gas-liquid separator 100. Furthermore, the fixed frame 4 may include a first connecting plate 42 and a second connecting plate 43 connected in a shape of L, an end of the first connecting plate 42 away from the second connecting plate 43 may be connected to the shell 1, and an end of the second connecting plate 43 away from the first connecting plate 42 may be connected to the filter member 3. In this way, it may improve structural strength of the fixed frame 4, so that the fixed frame 4 may be not easy to bend and deform.

Figure 5:
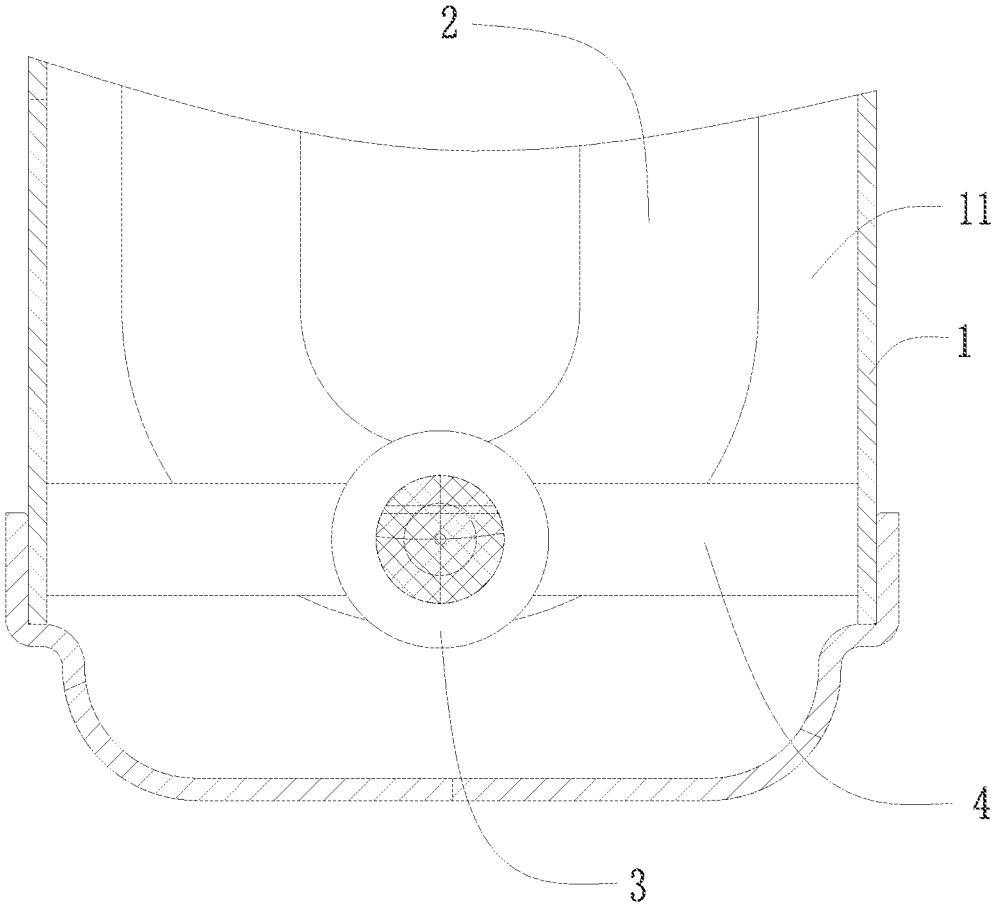
FIG. 5 is a first sectional diagram of a gas-liquid separator according to one or more embodiments.
Figure 6:
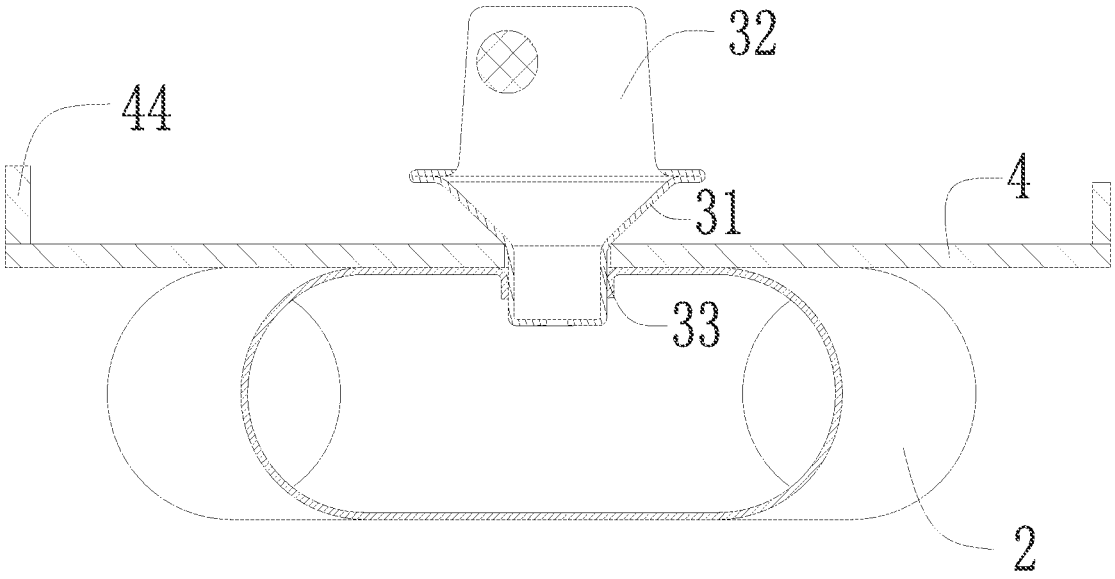
FIG. 6 is a second sectional diagram of a gas-liquid separator according to one or more embodiments.
Figure 7:
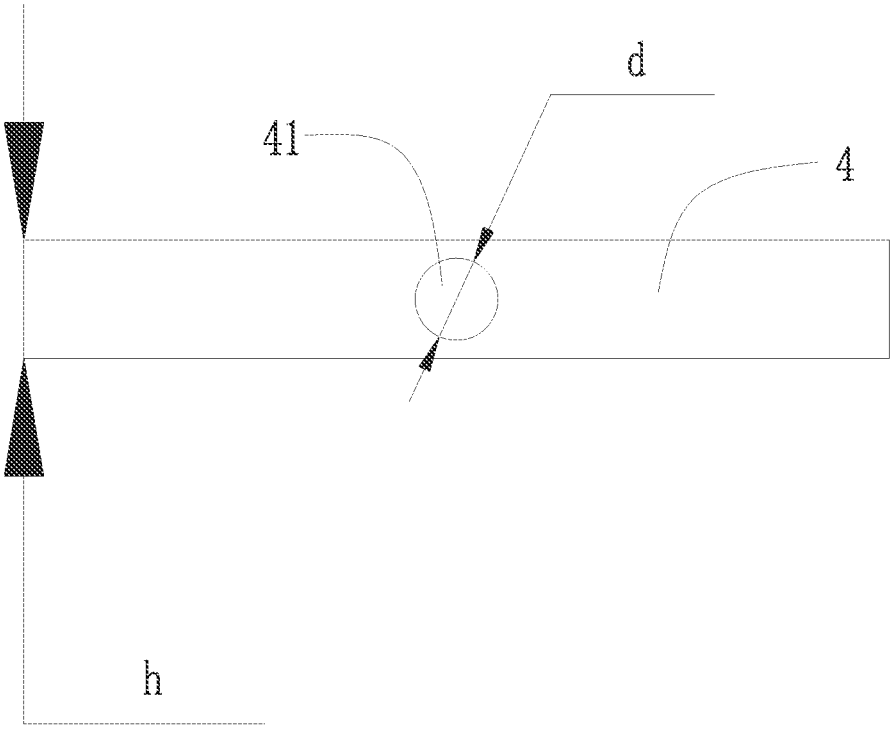
FIG. 7 is a schematic diagram of a fixed frame according to one or more embodiments.

In another embodiment, referring to FIG. 5 to FIG. 7, both ends of the fixed frame 4 may be connected to an inner wall of the shell 1 by welding, and the clamp hole 41 may be located at a center of the fixed frame 4. In this way, it may increase welding points between the fixed frame 4 and the shell 1, and improve connection strength between the fixed frame 4 and the shell 1. Specifically, both ends of the fixed frame 4 may be bent at 90° to form a flap structure 44, and the fixed frame 4 may be connected to the shell 1 by the flap structure 44 in a welding manner. In this way, it may further improve welding area between the fixed frame 4 and the shell 1, and increase welding strength between the fixed frame 4 and the shell 1.

In an embodiment, referring to FIG. 4 to FIG. 7, an inner diameter of the clamp hole 41 may be denoted as d, a width of the fixed frame 4 may be denoted as h, and the inner diameter d of the clamp hole 41 and the width h of the fixed frame 4 may satisfy the following relational formula: $0.3h \leq d \leq 0.7h$. In the relational formula, $d \geq 0.3h$, i.e., $h \leq 10d/3$. In this way, it is avoided that the width of the fixed frame 4 is too great to affect assembly flexibility of the fixed frame 4 in the liquid storage chamber 11. In the relational formula, $d \leq 0.7h$, thereby avoiding the inner diameter of the clamp hole 41 being too great to affect structural strength of the fixed frame 4.

Figure 8:
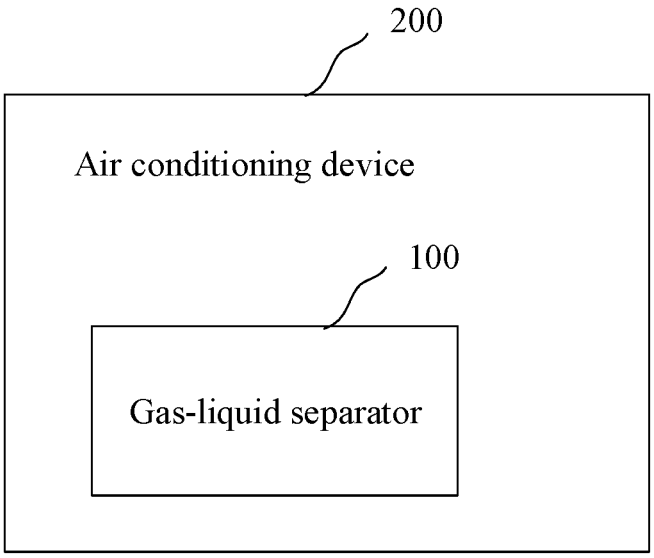
FIG. 8 is a schematic diagram of an air conditioning device according to one or more embodiments.

Referring to FIG. 8, the present disclosure further provides an air conditioning device 200, including the gas-liquid separator 100 in any one of the above embodiments.

In the gas-liquid separator 100 and the air conditioning device 200 provided in the present disclosure, since the gaseous refrigerant outlet pipe 2 is fixedly connected to the filter member 3, the fixed frame 4 is fixedly connected to the shell 1 and the filter member 3, thereby realizing a fixed connection between the gaseous refrigerant outlet pipe 2 and the shell 1. Compared with the gaseous refrigerant outlet pipe 2, the fixed frame 4 is easier to be fixedly connected to the filter member 3, and the fixed frame 4 and the filter member 3 have low connection difficulty. Therefore, in the present disclosure, the fixed frame 4 is fixedly connected to the filter member 3, greatly reducing connection difficulty between the gaseous refrigerant outlet pipe 2 and the shell 1.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

What is claimed is:

1. A gas-liquid separator, comprising a shell, a gaseous refrigerant outlet pipe, a filter member, and a fixed frame;

wherein the shell is provided with a liquid storage chamber;

the gaseous refrigerant outlet pipe is at least partially disposed in the liquid storage chamber, and a portion of the gaseous refrigerant outlet pipe located in the liquid storage chamber is provided with a filter port;

the filter member is fixedly connected to the filter port of the gaseous refrigerant outlet pipe to filter medium entering the gaseous refrigerant outlet pipe from the filter port; and the fixed frame is fixedly connected to the shell and the filter member;

the filter member comprises a screen, a connector, and a main seat body connecting to the screen and the connector, and the connector extends into the filter port and is fixedly connected to the gaseous refrigerant outlet pipe; and the fixed frame is provided with a clamp hole, and the fixed frame is sheathed on an outside of the connector by the clamp hole.

2. The gas-liquid separator of claim 1, wherein a portion of the fixed frame provided with the clamp hole abuts between the gaseous refrigerant outlet pipe and the main seat body.

3. The gas-liquid separator of claim 1, wherein an end of the fixed frame is connected to an inner wall of the shell by welding, and the other end of the fixed frame is provided with the clamp hole.

4. The gas-liquid separator of claim 3, wherein the fixed frame comprises a first connecting plate and a second connecting plate connected in a shape of L, an end of the first connecting plate away from the second connecting plate is connected to the shell, and an end of the second connecting plate away from the first connecting plate is connected to the filter member.

5. The gas-liquid separator of claim 1, wherein both ends of the fixed frame are connected to an inner wall of the shell by welding, and the clamp hole is located at a center of the fixed frame.

6. The gas-liquid separator of claim 5, wherein both ends of the fixed frame are bent at 90° to form a flap structure, and the fixed frame is connected to the shell by the flap structure in a welding manner.

7. The gas-liquid separator of claim 1, wherein an inner diameter of the clamp hole is denoted as d, a width of the fixed frame is denoted as h, and the inner diameter d of the clamp hole and the width h of the fixed frame satisfy the following relational formula: $0.3h \leq d \leq 0.7h$.

8. The gas-liquid separator of claim 1, wherein the main seat body is in a shape of a conical pipe, and an outer diameter of the main seat body gradually increases from an end of the main seat body proximal to the connector to the other end of the main seat body away from the connector; the screen is in a shape of a cylinder, and the screen is disposed on the end of the main seat body away from the connector.

9. An air conditioning device, comprising a gas-liquid separator, wherein the gas-liquid separator comprises a shell, a gaseous refrigerant outlet pipe, a filter member, and a fixed frame;

the shell is provided with a liquid storage chamber;

the gaseous refrigerant outlet pipe is at least partially disposed in the liquid storage chamber, and a portion of the gaseous refrigerant outlet pipe located in the liquid storage chamber is provided with a filter port;

the filter member is fixedly connected to the filter port of the gaseous refrigerant outlet pipe to filter medium entering the gaseous refrigerant outlet pipe from the filter port; and the fixed frame is fixedly connected to the shell and the filter member;

the filter member comprises a screen, a connector, and a main seat body connecting to the screen and the connector, and the connector extends into the filter port and is fixedly connected to the gaseous refrigerant outlet pipe; and the fixed frame is provided with a clamp hole, and the fixed frame is sheathed on an outside of the connector by the clamp hole.

10. The air conditioning device of claim 9, wherein a portion of the fixed frame provided with the clamp hole abuts between the gaseous refrigerant outlet pipe and the main seat body.

11. The air conditioning device of claim 9, wherein an end of the fixed frame is connected to an inner wall of the shell by welding, and the other end of the fixed frame is provided with the clamp hole.

12. The air conditioning device of claim 11, wherein the fixed frame comprises a first connecting plate and a second connecting plate connected in a shape of L, an end of the first connecting plate away from the second connecting plate is connected to the shell, and an end of the second connecting plate away from the first connecting plate is connected to the filter member.

13. The air conditioning device of claim 9, wherein both ends of the fixed frame are connected to an inner wall of the shell by welding, and the clamp hole is located at a center of the fixed frame.

14. The air conditioning device of claim 13, wherein both ends of the fixed frame are bent at 90° to form a flap structure, and the fixed frame is connected to the shell by the flap structure by welding.

15. The air conditioning device of claim 9, wherein an inner diameter of the clamp hole is denoted as d, a width of the fixed frame is denoted as h, and the inner diameter d of the clamp hole and the width h of the fixed frame satisfy the following relational formula: $0.3h \leq d \leq 0.7h$.

16. The air conditioning device of claim 9, wherein the main seat body is in a shape of a conical pipe, and an outer diameter of the main seat body gradually increases from an end of the main seat body proximal to the connector to the other end of the main seat body away from the connector; the screen is in a shape of a cylinder, and the screen is disposed on the end of the main seat body away from the connector.

* * * * *